US006154938A

United States Patent [19]

LaJeunesse et al.

[11] Patent Number: 6,154,938

[45] Date of Patent: Dec. 5, 2000

[54] WEDGE BAR LOCKING MECHANISM FOR A CASKET

[75] Inventors: John LaJeunesse, Batesville; Roger Reuss, Brookville; Louis Werner, Sunman, all of Ind.

[73] Assignee: Batesville Services, Inc., Batesville, Ind.

[21] Appl. No.: 09/370,323

[22] Filed: Aug. 9, 1999

Related U.S. Application Data

[63] Continuation of application No. 08/986,278, Dec. 6, 1997, abandoned.

[51] Int. Cl.[7] ..... A61G 17/00

[52] U.S. Cl. ..... 27/2; 27/17; 27/DIG. 1; 292/157; 292/161

[58] Field of Search ..... 27/2, 14, 16, 17, 27/DIG. 1; 292/161, 162, 156, 137, 145, 157, 160, DIG. 53; 411/508, 509, 913, 366, 419, 418, 417

[56] References Cited

U.S. PATENT DOCUMENTS

| | | | |
|---|---|---|---|
| 2,284,921 | 6/1942 | Purkiss . | |
| 2,323,674 | 7/1943 | Purkiss . | |
| 2,417,756 | 3/1947 | Hillenbrand . | |
| 2,582,841 | 1/1952 | McEwan . | |
| 2,821,770 | 2/1958 | Gruber . | |
| 2,864,640 | 12/1958 | Mattinson . | |
| 3,102,746 | 9/1963 | Kerr | 411/366 X |
| 3,845,976 | 11/1974 | Peterson | 292/DIG. 53 X |
| 3,981,054 | 9/1976 | Hull et al. | 27/17 |
| 4,486,040 | 12/1984 | Strangward | 292/160 |
| 4,622,725 | 11/1986 | Bumgardner | 411/508 X |
| 4,647,883 | 3/1987 | Oxley | 411/366 X |
| 4,952,106 | 8/1990 | Kubogochi et al. | 411/508 X |
| 5,476,350 | 12/1995 | Kurtz et al. | 411/508 X |
| 5,503,439 | 4/1996 | LaJeunesse et al. . | |

*Primary Examiner*—Anthony Knight
*Assistant Examiner*—William L. Miller
*Attorney, Agent, or Firm*—Wood, Herron & Evans, L.L.P.

[57] ABSTRACT

A casket having a body and a lid hinged to the body along a hinged edge, and an unhinged edge opposite the hinged edge, includes a wedge bar locking mechanism for locking the lid to the body in a closed position. The locking mechanism includes a wedge bar installed within a cavity of the casket body flange which extends along the unhinged edge, the wedge bar interacting with pull-down studs which are mounted on a flange of the lid and which extend into the cavity upon closing the lid via a plurality of openings in the body flange. The wedge bar is supported vertically by a plurality of hangers which reside within the openings in the body flange. Each hanger includes a radial flange and a cylindrical sleeve depending therefrom. The sleeve has two diametrically opposite vertical slots which receive the wedge bar and permit the wedge bar to move along its longitudinal axis for locking and unlocking the mechanism. The slots terminate at their lower ends at support surfaces on which the wedge bar rests. The hangers thereby support the wedge bar, and also act as grommets providing passageways for the pull-down studs.

16 Claims, 3 Drawing Sheets

WEDGE BAR LOCKING MECHANISM FOR A CASKET

This application is a continuation of application Ser. No. 08/986,278, filed Dec. 6, 1997, now abandoned.

FIELD OF THE INVENTION

The present invention relates to burial caskets and, more particularly, to a mechanism for locking the lid of a casket to the body of the casket.

BACKGROUND OF THE INVENTION

Burial caskets include a lid hingedly connected to a body along one longitudinal edge, to permit hinged movement of the lid to a closed position along the other longitudinal edge. The lid and the body include structural components which cooperate to permit the lid to be locked, or tightly sealed, to the body in the closed position so that the closed casket is airtight.

When the casket is initially closed, the body and the lid are in uninterrupted engagement along confronting flange surfaces which extend completely around the four walls of the casket. A compressible gasket or sealing tube also extends completely around the casket and resides between the engaged flange surfaces of the body and the lid. During locking, the lid is pulled downwardly toward the body to compress the gasket and to provide an airtight seal extending completely around the four walls of the casket.

For metal caskets, a wedge bar is commonly used to lock the lid to the body. The wedge bar resides within a hollow portion of the body of the casket, adjacent the flange, and it extends almost the entire length of the open, or nonhinged, side of the casket. The wedge bar is mounted in the casket body at a desired vertical position, and is movable horizontally along the longitudinal axis of the wedge bar. The wedge bar includes at least one, and preferably three or four, catches having cam surfaces. The catches may be integrally formed with the wedge bar or separately attached thereto. Each catch resides immediately below a small opening in the flange along the nonhinged edge of the body. The nonhinged edge of the lid includes a corresponding number of keeper elements mounted thereto and directed downwardly, and these elements are aligned with the openings and catches. When the lid is closed, the keeper elements extend downwardly through the openings, with each keeper element positioned adjacent a catch.

Longitudinal movement of the wedge bar in a first direction toward a first end wall of the casket causes the catches to engage the keeper elements, and the keeper elements are cammed downwardly by the caches until the wedge bar stops moving. This camming action pulls the lid downwardly to the sealed position. A screw mounted within the body has a head end which is accessible through a port in the first end wall. This screw operatively connects to one end of the wedge bar, and the screw is held in place relative to the body by a bracket, which is fixedly secured to the body. Rotating the screw in one direction moves the wedge bar toward the first end wall, which locks the casket. Rotating the screw in an opposite direction moves the wedge bar toward the opposite end wall, which unlocks the casket. The screw is rotated from outside the first end wall, via the port therein.

The wedge bar is secured beneath the body flange by a plurality of hanger elements which attach at their upper ends to the body flange and hang or project downwardly therefrom. Each hanger element is stamped from sheet metal and bent into a generally U-shaped member, the vertical legs of which define a channel within which the wedge bar resides. The upper ends of the vertical legs are attached to the body flange by rivets which extend through holes in the body flange and through holes in flanges at the upper ends of the legs, and/or by tabs on the upper ends of the legs which engage holes in the body flange.

In addition to the hanger elements, there are a plurality of grommets installed in the openings in the body flange. The grommets are usually made of plastic, and assist in providing low-friction guideways for the keeper elements to pass through when the lid is closed.

While this design using such hanger elements has generally been satisfactory, there is room for improvement. For instance, a significant number of parts must be secured in the body flange prior to or in the process of installing the wedge bar. Specifically, there are typically four hanger elements, each of which must be riveted and/or hammered into place, and three or four grommets which must be installed in the openings in the body flange. Additionally, because of the significant number of parts, there are a significant number of separate assembly steps, all of which must be performed by human labor. Thus, installation is not as rapid as it could be. Further, when the hanger elements are attached to the body flange with rivets and/or tabs, installation requires the use of tools such as rivet guns and/or hammers, complicating the installation procedure. Therefore, manufacturing and installation costs are not as low as they could be.

SUMMARY OF THE INVENTION

The invention overcomes the above-described drawbacks by providing a wedge bar locking mechanism, and a method of installing a wedge bar, in which the wedge bar is supported in the casket by a plurality of wedge bar hangers installed in the openings in the body flange. Each of the hangers has a grommet portion which resides in the body flange opening and defines a low-friction passage for a keeper to pass through upon closing of the lid, and a hanger portion which depends from the grommet portion. The hanger portion comprises a tubular or cylindrical sleeve which has two diametrically opposite slots through its sidewall. The slots are shaped and sized to receive the wedge bar, and include lower surfaces at the bottoms of the slots upon which the wedge bar rests. During locking or unlocking of the mechanism, the wedge bar is actuated to move longitudinally, sliding along the lower surfaces of the hanger slots. The side surfaces of the slots substantially prevent transverse movement of the wedge bar, and upper surfaces of the slots substantially prevent vertical upward movement of the wedge bar. Thus, the wedge bar is securely held in place beneath the body flange.

In a preferred embodiment, the wedge bar hanger comprises an integrally formed one-piece structure made out of a plastic material, including a cylindrical sleeve with a radially extending flange on its upper end and hooks projecting outward from its outer surface spaced below and adjacent to the radial flange. The hooks extend to a diameter slightly greater than the diameter of the body flange opening. The hanger is affixed in the body flange opening by inserting the sleeve downward through the opening and exerting sufficient force on the radial flange to cause the hooks to deflect radially inwardly and thereby pass through the opening. The hooks then resiliently return to their normal at rest diameter. The hanger is thus secured in place by interference between the radial flange and the upper surface of the body flange, and between the hooks and the lower surface of the body flange. The cylindrical sleeve is preferably slit from the bottoms of the slots downward to the lower end of the sleeve, thereby forming two semi-cylindrical portions of the sleeve. The two semi-cylindrical portions may be forced apart to allow the wedge bar to pass upward between them and into the slots, whereupon the flexibility of the plastic material causes the two portions to return to their normal at rest positions substantially closing the bottom ends of the slots so that the wedge bar is retained within the slots.

Instead of using four hanger elements and four separate grommets, as in the prior wedge bar locking mechanism, the wedge bar locking mechanism of the present invention requires substantially fewer parts, for example, only three wedge bar hangers of the type described above. Accordingly, manufacturing costs are significantly reduced. Moreover, the wedge bar hangers may be installed by hand, and require fewer separate installation steps to install. Thus, installation costs are significantly reduced.

The above and other advantages of the invention will become more apparent by reference to the following detailed description and the accompanying drawings.

BRIEF DESCRIPTION OF THE DRAWINGS

The accompanying drawings, which are incorporated in and constitute a part of this specification, illustrate an embodiment of the invention and, together with the general description of the invention given above and the detailed description given below, serve to explain the principles of the invention.

DETAILED DESCRIPTION OF THE DRAWINGS

Figure 1:
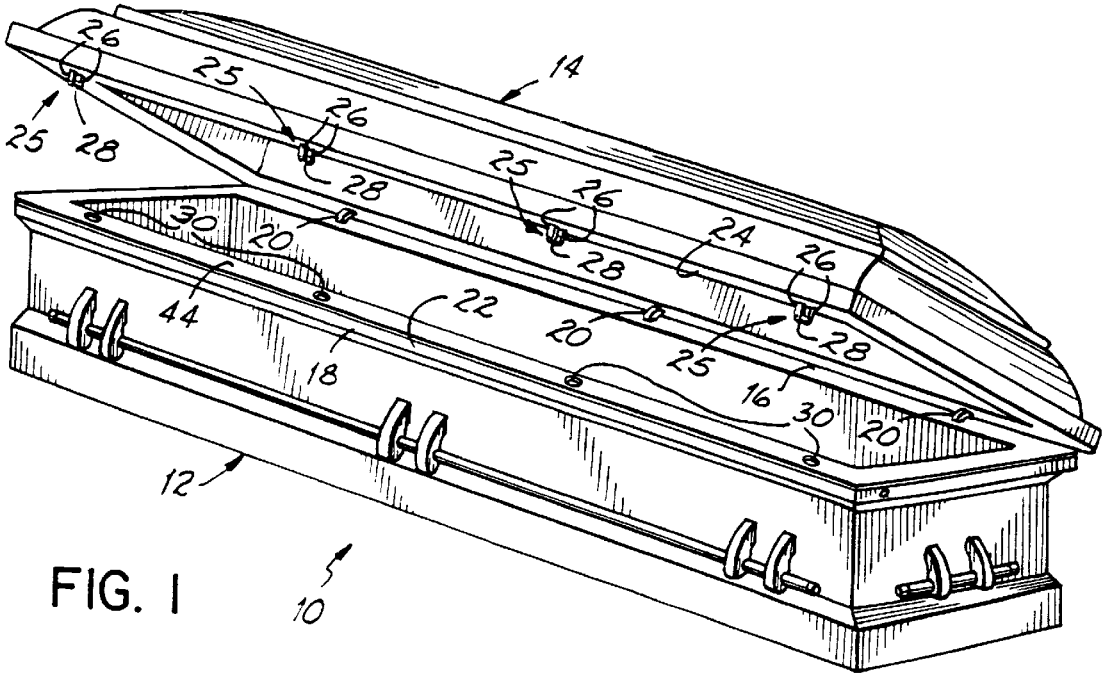
FIG. 1 is a perspective view of a casket incorporating a wedge bar locking mechanism in accordance with the present invention.

FIG. 1 depicts a casket 10 in which a wedge bar locking mechanism in accordance with the principles of the present invention may be installed. The casket includes a body 12, and a lid 14 which is hingedly connected to the body 12 along a hinge edge 16 thereof. The lid 14 closes upon the body 12 via hinged motion about the hinge edge 16, to place the body 12 and the lid 14 in contact along an opposite edge 18. A number of hinges 20 interconnect the body 12 and the lid 14 along the hinge edge 16, as is known in the industry.

The body 12 includes a flange 22, and the lid 14 includes a corresponding flange 24. The body flange 22 and the lid flange 24 are in continuous engagement completely around the four walls of the casket 10 when the lid 14 is closed on the body 12. A compressible gasket 44 resides between the confronting flanges 22 and 24, as is known in the industry. The lid 14 includes a number of pull-down fasteners or keepers 25, mounted on the lid flange 24 adjacent the second edge 18. FIG. 1 shows four keepers 25 equally spaced along edge 18. Each keeper 25 preferably includes a pair of spaced studs 26 which hold a roller 28 therebetween, with the roller 28 oriented transverse to the longitudinal dimension of the casket 10. On the body 12, the flange 22 includes a like number of openings 30, and each opening 30 corresponds to one of the keepers 25. Upon closing of the lid 14, the studs 26 and associated rollers 28 extend downwardly through the openings 30.

Figure 2:
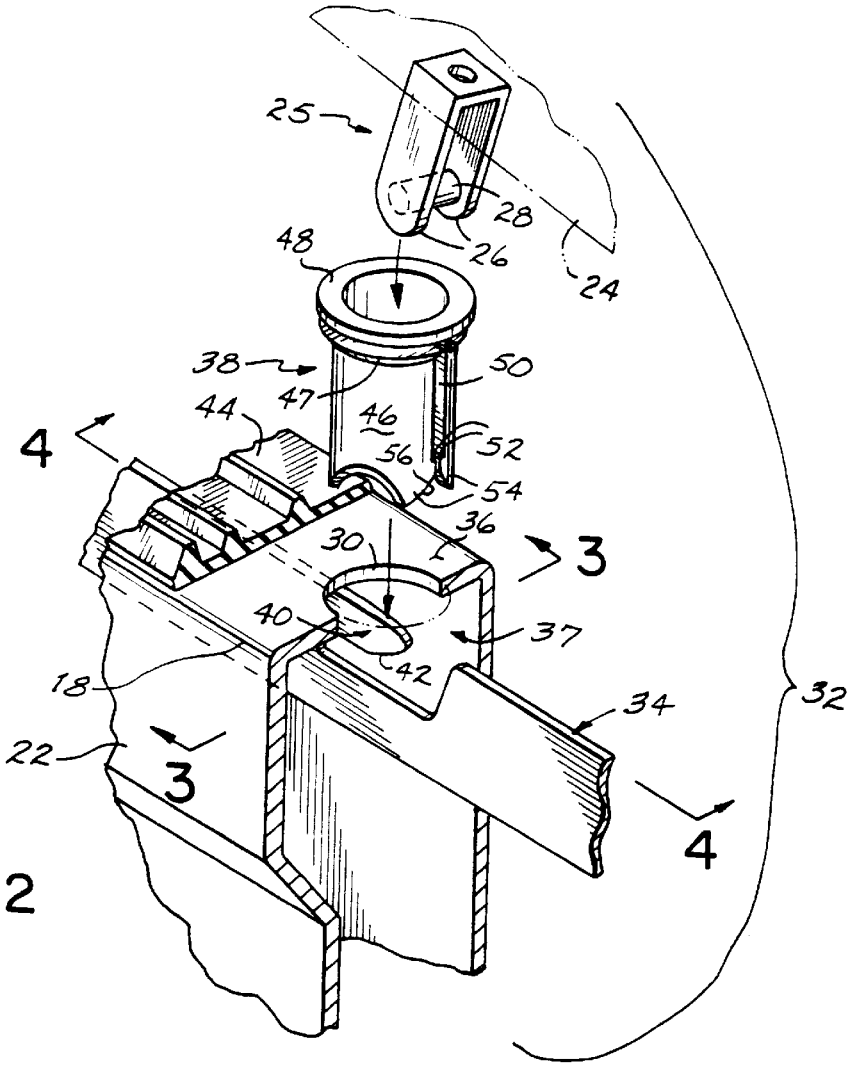
FIG. 2 is an exploded view of portions of the casket body flange and lid showing the components of the wedge bar locking mechanism according to a first embodiment of the invention.

With reference to FIG. 2, the lid 14 may be locked in the closed position on the body 12 by a wedge bar locking mechanism 32. The wedge bar locking mechanism 32 includes the keepers 25, and a wedge bar 34 which resides below the upper wall 36 of the body flange 22 within a cavity 37 in the body 12. The wedge bar 34 extends longitudinally along the length of the casket 10 along the edge 18. The wedge bar 34 is held at a desired vertical level within the cavity 37 by wedge bar hangers 38 which permit longitudinal reciprocal motion of the wedge bar 34 along its longitudinal axis, or parallel with the edge 18.

This longitudinal motion of the wedge bar 34 causes locking and unlocking of the lid 14 to the body 12. To this end, the wedge bar 34 includes a number of cutout regions which define catches 40, each catch 40 corresponding to an opening 30 and an associated roller 28. Each catch 40 is defined in shape via a tapered edge 42 which serves as a cam surface and cooperates with a respective roller 28, which serves as a cam follower. When the wedge bar 34 moves longitudinally in a first direction (generally toward the right in FIG. 2), the catches 40 engage the rollers 28 and gradually pull them downwardly, at a rate and distance dependent on the angle of the tapered edges 42. This downward pulling of the rollers 28 also pulls the lid 14 downwardly with respect to the body 12 so that their corresponding flanges 24 and 22 are compressed together along the edge 18, along with the other three edges of the casket 10. This downward pulling compresses the gasket 44 residing between the flanges 22 and 24 to lock the casket 10 in a sealed, airtight condition.

To unlock the casket 10, the wedge bar 34 is moved longitudinally in a second direction opposite to the first direction. This causes the catches 40 to disengage the rollers 28, allowing the lid 14 to be lifted with respect to the body 12. The operation of the wedge bar 34 in cooperation with the rollers 28 is known in the burial casket industry, and does not form any part of the present invention. The present invention relates to an improved mechanism for installing the wedge bar 34 within the cavity 37, and to improved methods of installing a wedge bar 34 within a casket 10.

More particularly, FIGS. 2–5 depict a first embodiment of a wedge bar installation in accordance with the principles of the present invention. Each opening 30 in the body flange 22 has a hanger 38 associated therewith. Each hanger 38 has a tubular sleeve portion 46 and an integral radial flange 48 at one end of the sleeve portion 46. A hanger 38 sits in an opening 30 with the radial flange 48 in contact with the upper wall 36 of the body flange 22 and the sleeve portion 46 extending downward through the opening 30 into the cavity 37. The sleeve 46 includes outwardly extending hooks 47 on its outer surface, which are spaced below the radial flange 48 by about the thickness of the upper wall 36 of the body flange 22. The hooks 47 are depressed inwardly when the hanger 38 is installed into the opening 30, but spring back to their undeformed positions when they have cleared the opening 30. The hooks 47 prevent the hanger 38 from inadvertently being withdrawn upwardly from the opening 30. The hanger 38 preferably is integrally made in one piece, for example, by being molded of a plastic material.

Figure 4:
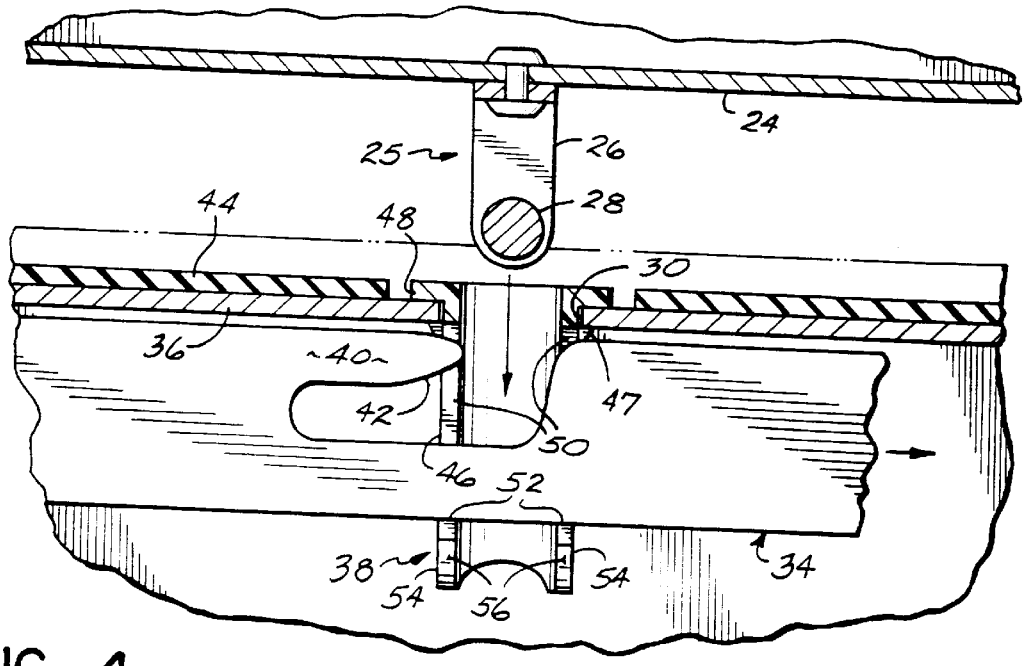
FIG. 4 is a cross-sectional view taken on line 4—4 of FIG. 2, showing the lid in a position prior to being closed against the body flange, with the keeper element of the lid not yet engaging the wedge bar.
Figure 5:
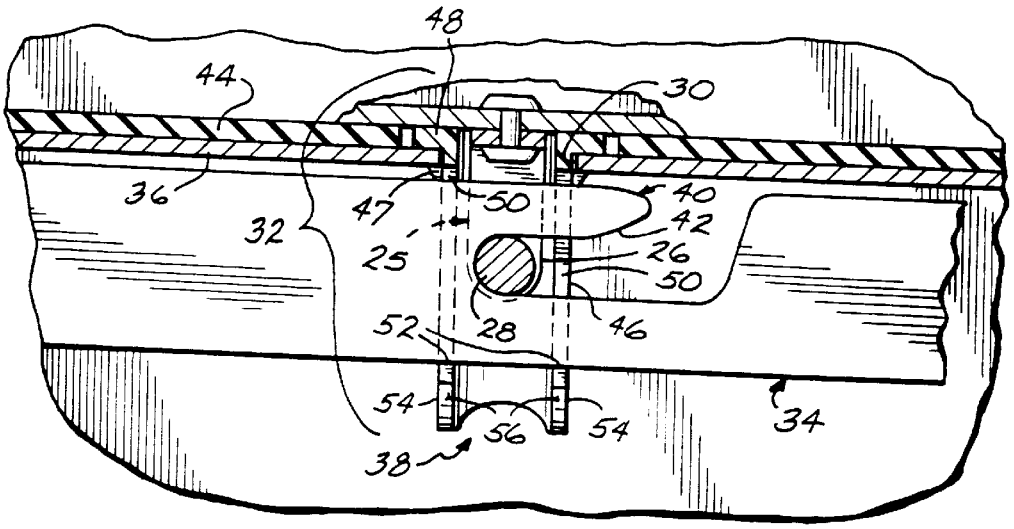
FIG. 5 is a view similar to FIG. 4, showing the lid in a closed position against the body flange, with the keeper element inserted within the opening of the wedge bar hanger and the wedge bar moved longitudinally to engage the keeper element.

The hanger 38 includes a pair of elongated vertical slots 50 in the sleeve portion 46 at diametrically opposite positions. The slots 50 receive the wedge bar 34, the lower ends of the slots 50 terminating at surfaces 52 on which the wedge bar 34 rests. A plurality of hangers 38 are installed in a plurality of body flange openings 30, with the slots 50 oriented to form a longitudinally extending passage for the wedge bar 34 to reside in, as best seen in FIGS. 2, 4, and 5. The wedge bar 34 is thus supported vertically, and yet is free to be moved longitudinally to lock and unlock the casket, as described above.

Figure 3:
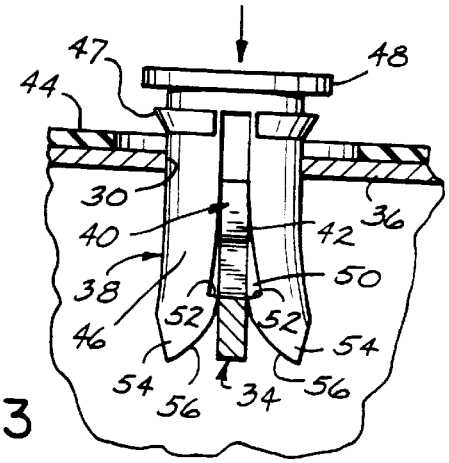
FIG. 3 is a cross-sectional view taken on line 3—3 of FIG. 2, showing a first embodiment of a wedge bar hanger being installed into one of the openings in the body flange, with the wedge bar being forced into the slot in the hanger.
Figure 3A:
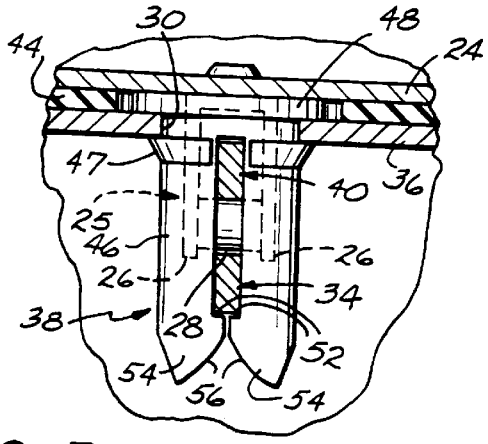
FIG. 3A is a cross-sectional view similar to FIG. 3, showing the wedge bar hanger fully installed in the body flange opening, with the wedge bar retained within the slot in the hanger.

To facilitate installation of the hangers 38 and the wedge bar 34, each hanger 38 preferably is slit from the lower end surfaces 52 of each slot downward to the lower end of the sleeve portion 46. The sleeve portion 46 is thereby split into two semi-cylindrical portions or legs 54. The hanger 38 is preferably made of a material having sufficient flexibility and resiliency that the legs 54 may be flexed away from one another as shown in FIG. 3 and, when released, they will spring back into their undeflected shapes as shown in FIG. 3A. Thus, installing the wedge bar 34 and the hangers 38 is accomplished by positioning the wedge bar 34 within the cavity 37 of the body flange 22 below the openings 30, and inserting hangers 38 into the openings. As each hanger 38 is inserted, the legs 54 are forced away from each other by the wedge bar 34, as shown in FIG. 3. The lower ends of the legs 54 include sloping surfaces 56 which slope downwardly and outwardly from the slots 50, forming an inverted "V" shape with the vertex located at the lower ends of the slots 50. The wedge bar 34 rides along the sloping surfaces 56, spreading the legs 54 apart. When the hanger 38 has been fully inserted in the opening 30, the wedge bar 34 is fully within the slots 50, and the legs 54 spring back into their original undeflected shapes. The wedge bar 34 is retained within the slots 50, resting on the surfaces 52. All of the hangers 38 are installed into the openings 30, snapping over the wedge bar 34, and the wedge bar 34 is thus suspended below the upper wall 36 of the body flange 22. Alternatively, the hangers 38 may first be installed into the openings 30, and then the wedge bar 34 may be vertically inserted upwardly into the slots 50.

With the wedge bar 34 installed, locking of the wedge bar mechanism is accomplished by closing the lid 14 as shown in FIG. 4, and then moving the wedge bar 34 longitudinally, to the right as shown in FIG. 5, to engage the rollers 28 with the catches 40 of the wedge bar 34. Unlocking is accomplished by reversing the movement of the wedge bar 34 to disengage the catches 40 from the rollers 28. Mechanisms for causing longitudinal movement of the wedge bar 34 are known, as shown, for example, in U.S. Pat. No. 5,503,439, issued Apr. 2, 1996, and assigned to the assignee of the present application, the disclosure of which is incorporated herein by reference.

Figure 6:
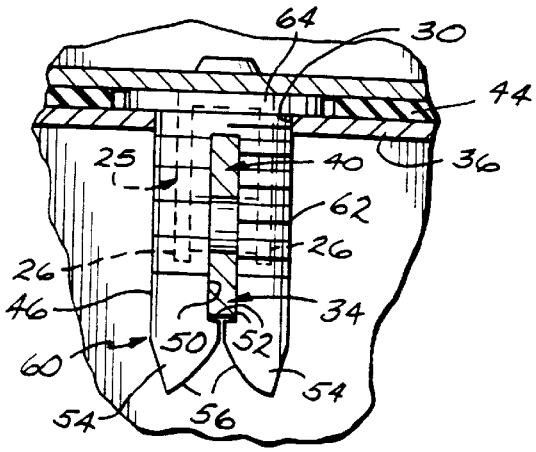
FIG. 6 is a view similar to FIG. 3A, showing a second embodiment of a wedge bar hanger in accordance with the invention.

FIG. 6 depicts an alternative embodiment of a hanger 60 for the wedge bar 34. The hanger 60 differs from the hanger 38 primarily in its construction. The hanger 60 comprises a threaded pipe 62 and a nut 64 threadably attached to the upper end of the pipe 62 to retain the hanger 60 within an opening 30 in the body flange 22. The hanger 60 preferably is made of a flexible and resilient plastic material.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, while the hangers 38 and 60 are shown as being split at the lower ends of the slots 50 to permit the wedge bar 34 to be vertically inserted into the slots 50, the hangers could alternatively be unsplit and the wedge bar 34 could be inserted horizontally into the slots 50. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A wedge bar locking mechanism in combination with a casket, said casket including a body and a lid, said mechanism locking said lid to said body along an unhinged edge of said body, said body including a flange along said unhinged edge of said body, said body flange including at least one opening therein, said mechanism including:

at least one keeper mounted on said lid adjacent an unhinged edge thereof so that upon closing said lid to said body, said keeper extends through said at least one opening in said body flange;

a wedge bar mounted beneath a lower surface of said body flange, said wedge bar movable longitudinally toward and away from an end wall of said body to lock and unlock said lid to said body, respectively, said wedge bar including at least one catch located below said at least one opening in said body flange; and a wedge bar hanger secured in said at least one opening of said body flange and supporting said wedge bar, said hanger including a grommet portion and a depending hanger portion, said grommet portion having a central hole through which said at least one keeper extends upon closing of said lid, said hanger portion including surfaces which engage said wedge bar to secure said wedge bar against substantial vertical and transverse movements thereof while permitting longitudinal movement of said wedge bar toward and away from said end wall for locking and unlocking said casket.

2. The combination of claim 1, wherein said wedge bar hanger includes a generally tubular member having a sidewall defining said hanger portion, said generally tubular member having a pair of slots extending through approximately diametrically opposite portions of said sidewall below said body flange, said slots containing said wedge bar and having lower surfaces upon which said wedge bar rests and side surfaces which prevents substantial transverse movement of said wedge bar.

3. The combination of claim 2 wherein said generally tubular member is split from the bottoms of said slots downward to the lower end of said tubular member thereby defining two semi-tubular members, and the material of said tubular member is sufficiently flexible and resilient that said two semi-tubular members may be spread apart to permit said wedge bar to pass therebetween and into said slots during installation of said wedge bar mechanism in said casket.

4. The combination of claim 2 wherein said generally tubular member comprises a length of cylindrical pipe which is threaded, said hanger further including, a correspondingly threaded nut, an upper end of said pipe extending upwardly through said at least one opening and engaging said nut to secure said hanger within said opening.

5. The combination of claim 2 wherein said generally tubular member comprises a cylindrical sleeve, said hanger further including a radially extending flange integrally attached to an upper end of said sleeve, said sleeve including hooks on an outer surface thereof, said hanger being secured within said at least one opening by interference between said radial flange and an upper surface of said body flange adjacent said at least one opening and between said hooks and a lower surface of said body flange adjacent said at least one opening.

6. The combination of claim 5 wherein said sleeve is split from the bottoms of said slots downward to the lower end of said sleeve thereby defining two semi-cylindrical members, and the material of said sleeve is sufficiently flexible and resilient that said two semi-cylindrical members may be spread apart to permit said wedge bar to pass therebetween and into said slots during installation of said wedge bar mechanism in said casket, said semi-cylindrical members then returning to their undeformed positions retaining said wedge bar within said slots.

7. The combination of claim 6, further comprising a plurality of openings in said body flange and a corresponding number of keepers mounted on said lid and arranged to pass through said openings upon closing of said lid, each opening having one said wedge bar hanger installed therein.

8. A method of installing a wedge bar in a casket having a body with a flange at an upper end thereof which confronts a flange of a lid of said casket along an unhinged edge of said casket when said lid is in the closed position, said casket including a cavity within said body flange, said cavity extending along said unhinged edge of said casket, said body flange including a plurality of openings into said cavity, said openings being spaced apart along said unhinged edge, the method comprising:

positioning said wedge bar within said cavity below said openings;

inserting a hanger in each opening, each hanger including a radial flange and a pair of depending legs which define a bar-receiving space therebetween for receiving said wedge bar, said legs including support surfaces providing vertical support to said wedge bar when said wedge bar is disposed within said bar-receiving space, said legs having lower ends which are movable away from each other to permit said wedge bar to be inserted in a vertical direction upward into said bar-receiving space;

moving said legs of each hanger away from each other;

causing relative vertical movement between each hanger and said wedge bar to cause said wedge bar to move between said moved-apart legs into said bar-receiving space of each hanger; and moving said legs of each hanger back toward each other so that said wedge bar is vertically supported within said bar-receiving space by said support surfaces.

9. The method of claim 8, wherein the first moving step comprises relatively moving said wedge bar and said hangers toward each other so that said wedge bar bears against downwardly facing surfaces of said depending legs of each hanger so as to cause said legs of each hanger to move away from each other to permit said wedge bar to be moved into said bar-receiving space, and the second moving step occurs by virtue of said legs resiliently returning to undeformed positions proximate one another when said wedge bar has been fully moved into said bar-receiving space.

10. The method of claim 9, wherein the causing step comprises pushing said wedge bar upward against stationary hangers which have been fully installed in said body flange openings.

11. The method of claim 9, wherein the causing step comprises pushing said hangers downwardly through said body flange openings against said wedge bar which is stationary beneath said openings.

12. A combination of a wedge bar and a combined wedge bar hanger and keeper guideway for use in a casket having a body and a lid, the body including a body flange with a cavity therein, the lid including a keeper and the body flange having an opening through which the keeper extends upon closing the lid against the body flange, said wedge bar being adapted to be located in the cavity and being longitudinally moveable to engage and disengage the keeper for locking and unlocking the lid in a closed position against the body, said combined wedge bar hanger and keeper guideway comprising:

a wedge bar hanger adapted to be secured in the opening of the body flange, said hanger including a grommet portion and a depending hanger portion, said grommet portion having a central hole through which the keeper extends upon closing of the lid, said hanger portion including surfaces engaging said wedge bar to secure said wedge bar against substantial vertical and transverse movements thereof while permitting longitudinal movement of said wedge bar for locking and unlocking the casket;

wherein said wedge bar hanger includes a generally tubular member having a sidewall defining said hanger portion, said generally tubular member having a pair of slots extending through approximately diametrically opposite portions of said sidewall, said slots containing said wedge bar and having lower surfaces vertically supporting said wedge bar and side surfaces preventing substantial transverse movement of said wedge bar.

13. The combination of claim 12 wherein said generally tubular member is split from the bottoms of said slots downward to the lower end of said tubular member thereby defining two semi-tubular members, and the material of said tubular member is sufficiently flexible and resilient that said two semi-tubular members may be spread apart to permit said wedge bar to pass therebetween and into said slots during assembly.

14. The combination of claim 12 wherein said generally tubular member comprises a length of cylindrical pipe which is threaded, said hanger further including a correspondingly threaded nut, an upper end of said pipe adapted to extend upwardly through the opening in the body flange and engage said nut to secure said hanger within the opening.

15. The combination of claim 12 wherein said generally tubular member comprises a cylindrical sleeve, said hanger further including a radially extending flange integrally attached to an upper end of said sleeve, said sleeve including hooks on an outer surface thereof, said hanger being securable within the opening by interference between said radial flange and an upper surface of the body flange adjacent the opening and between said hooks and a lower surface of the body flange adjacent the opening.

16. The combination of claim 15 wherein said sleeve is split from the bottoms of said slots downward to the lower end of said sleeve thereby defining two semi-cylindrical members, and the material of said sleeve is sufficiently flexible and resilient that said two semi-cylindrical members may be spread apart to permit said wedge bar to pass therebetween and into said slots during assembly, said semi-cylindrical members then returning to their undeformed positions retaining said wedge bar within said slots.

* * * * *